US009353630B2

(12) United States Patent
Osako et al.

(10) Patent No.: US 9,353,630 B2
(45) Date of Patent: May 31, 2016

(54) TURBINE ROTOR

(71) Applicant: MITSUBISHI HEAVY INDUSTRIES, Tokyo (JP)

(72) Inventors: Katsuyuki Osako, Tokyo (JP); Atsushi Matsuo, Tokyo (JP); Takao Yokoyama, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 14/692,451

(22) Filed: Apr. 21, 2015

(65) Prior Publication Data

US 2015/0300178 A1 Oct. 22, 2015

Related U.S. Application Data

(62) Division of application No. 13/376,554, filed as application No. PCT/JP2010/052266 on Feb. 16, 2010, now Pat. No. 9,039,374.

(30) Foreign Application Priority Data

Jun. 26, 2009 (JP) ..... 2009-152829

(51) Int. Cl.
*F01D 5/22* (2006.01)
*F01D 5/04* (2006.01)
(Continued)

(52) U.S. Cl.
CPC *F01D 5/141* (2013.01); *F01D 5/02* (2013.01); *F01D 5/043* (2013.01); *F01D 5/048* (2013.01);
(Continued)

(58) Field of Classification Search
CPC ..... F01D 5/043; F01D 5/141; F01D 5/20; F01D 5/048; F05D 2240/30
USPC ..... 415/173.1, 203–206; 416/183, 185, 416/186 R, 188, 223 B, 238, 242
See application file for complete search history.

(56) References Cited

U.S. PATENT DOCUMENTS 5,685,696 A 11/1997 Zangeneh et al.
9,039,374 B2 * 5/2015 Osako ..... F01D 5/043 416/185
(Continued)

FOREIGN PATENT DOCUMENTS

JP 8-144707 A 6/1996
JP 10-504621 A 5/1998
(Continued)

OTHER PUBLICATIONS

Chinese Office Action mailed Nov. 13, 2013 in corresponding Application No. 201080026091.6 with English Translation.
(Continued)

*Primary Examiner* — Christopher Verdier
(74) *Attorney, Agent, or Firm* — Birch, Stewart, Kolasch & Birch, LLP

(57) ABSTRACT

A turbine rotor of a turbine includes a hub that serves as an axis of rotation, and a plurality of turbine blades. The turbine blades each have a line extending along a shroud-side edge of the turbine blade from the inlet to the outlet as a shroud line. The shroud line includes an entrance-side shroud line La that makes a small change from the inlet toward the outlet in a blade angle with respect to the axis of rotation, a center shroud line Lb that extends from the outlet side of the entrance-side shroud line La and makes a greater change than that of the entrance-side shroud line La, and an exit-side shroud line Lc that extends from the outlet side of the center shroud line Lb to the outlet and makes a smaller change than that of the center shroud line Lb.

3 Claims, 13 Drawing Sheets

(51) Int. Cl.

| | |
|---|---|
| ***F01D 5/14*** | (2006.01) |
| ***F01D 5/02*** | (2006.01) |
| ***F01D 25/24*** | (2006.01) |
| *F01D 5/20* | (2006.01) |

(52) U.S. Cl.
CPC . *F01D 25/24* (2013.01); *F01D 5/20* (2013.01); *F05D 2240/30* (2013.01); *F05D 2250/71* (2013.01)

(56) References Cited

U.S. PATENT DOCUMENTS

| | | | |
|---|---|---|---|
| 2004/0105756 | A1 | 6/2004 | Higashimori et al. |
| 2007/0128018 | A1 | 6/2007 | Sumser et al. |

FOREIGN PATENT DOCUMENTS

| | | | |
|---|---|---|---|
| JP | 2008-503677 | A | 2/2008 |
| JP | 2008-133765 | A | 6/2008 |
| JP | 2008-133766 | A | 6/2008 |
| WO | WO 95/34744 | A1 | 12/1995 |
| WO | WO 2005/124107 | A2 | 12/2005 |

OTHER PUBLICATIONS

Japanese Office Action, dated Aug. 20, 2013, for Patent Application No. 2009-152829.

Notice of Allowance issued in Korean Application No. 2011-7030839 dated Sep. 3, 2013 with a partial English translation.

Notification on the Grant of Patent Right for Invention in corresponding Chinese Application No. 201080026091.6 dated Aug. 29, 2014 with English translation.

* cited by examiner

TURBINE ROTOR

This application is a Continuation of co-pending U.S. patent application Ser. No. 13/376,554 filed on Dec. 6, 2011 which is now U.S. Pat. No. 9,039,374, which is a National Phase of PCT/JP2010/052266 filed on Feb. 16, 2010 which claims priority under 35 U.S.C. §119(a) to Patent Application No. JP 2009-152829 filed in Japan on Jun. 26, 2009, all of which are hereby expressly incorporated by reference in their entirety.

FIELD

The present invention relates to a turbine rotor of a radial turbine, a mixed flow turbine, or the like that makes a working fluid flowing into in a radial direction flow out in an axial direction.

BACKGROUND

A turbine impeller (turbine rotor) having a plurality of turbine blades arranged around a main shaft has been known heretofore (for example, see Patent Literature 1). The turbine blades of this turbine impeller are such that, among the blade angles of their fluid outlet trailing edge, a blade angle (angle of a camber surface with respect to the main shaft) $\beta_{MEAN}$ of a mean section between a hub section (hub side) and a tip section (shroud side) is set based on a predetermined calculation formula with the blade angle $\beta_{TIP}$ of the tip section, the distance $R_{MEAN}$ from the hub section to the mean section, and the distance $R_{TIP}$ from the hub section to the tip section as variables. This can make the turbine blades capable of improving the performance of a radial turbine.

CITATION LIST

Patent Literature

Patent Literature 1: Japanese Patent Application Laid-Open No. 2008-133765

SUMMARY

Technical Problem

By the way, when a turbine has the foregoing turbine rotor, a shroud being a casing of the turbine rotor is arranged outside the turbine rotor. Here, the turbine blades of the turbine rotor and the shroud have a clearance therebetween so as to allow rotation of the turbine rotor.

Here, the turbine performance may drop if a working fluid leaks through the clearance between the turbine blades and the shroud. A cause of the working fluid leakage is that the turbine blades have a pressure surface on one side and a suction surface on the other, and a difference in pressure between the pressure surface and the suction surface increases on the shroud side of the turbine blades. Specifically, when the working fluid flowing over the suction surface increases in flow velocity on the shroud side of the turbine blade, the pressure on the suction surface decreases to increase the pressure difference between the pressure surface and the suction surface. The greater the pressure difference between the pressure surface and the suction surface is, the easier it is for the working fluid flowing into the turbine rotor to leak through the clearance between the turbine blades and the shroud. The turbine performance drops accordingly as much as the leakage of the working fluid.

It is thus an object of the present invention to provide a turbine rotor that can improve turbine performance.

According to an aspect of the present invention, a turbine rotor of a turbine that makes a working fluid flowing into in a radial direction through an inlet flow out in an axial direction through an outlet, includes: a hub that is rotatable about an axis of rotation; and a plurality of turbine blades that are arranged on a peripheral surface of the hub, and receive and direct the inflowing working fluid from the inlet toward the outlet. The turbine blades each are connected to the hub at a bottom side, or hub side, and have a free end on a tip side, or shroud side, a line extending from the inlet to the outlet along a shroud-side edge of each turbine blade is a shroud line, and the shroud line includes a first shroud line that makes a small change from the inlet toward the outlet in a blade angle with respect to the axis of rotation, a second shroud line that extends from the outlet side of the first shroud line and makes a greater change than that of the first shroud line, and a third shroud line that extends from the outlet side of the second shroud line to the outlet and makes a smaller change than that of the second shroud line.

According to such a configuration, it is possible to make the change in the blade angle of the second shroud line greater than the changes in the blade angle of the first shroud line and the third shroud line. As employed herein, the blade angle refers to the tilt angle of the shroud line with respect to the axis of rotation. It is therefore possible to make the change in the blade angle of the turbine blades on the second shroud line greater and make the changes in the blade angle of the turbine blades on the first shroud line and the third shroud line smaller. Since it is thereby possible to suppress an increase in the flow velocity of the working fluid that flows over the suction surfaces on the shroud side of the turbine blades, it is possible to suppress a drop in pressure on the suction surfaces on the shroud side of the turbine blades. This can reduce a difference in pressure between the pressure surfaces and the suction surfaces, and suppress leakage of the working fluid through the clearance between the turbine blades and the shroud.

Advantageously, in the turbine rotor, a blade angle of the third shroud line decreases toward the outlet.

According to such a configuration, the outlet-side intervals between the turbine blades can be formed in a nozzle shape for improved turbine efficiency.

According to another aspect of the present invention, a turbine rotor of a turbine that makes a working fluid flowing into in a radial direction through an inlet flow out in an axial direction through an outlet, includes: a hub that is rotatable about an axis of rotation; and a plurality of turbine blades that are arranged on a peripheral surface of the hub, and receive and direct the inflowing working fluid from the inlet toward the outlet. The turbine blades each are connected to the hub at a bottom side, or hub side, and have a free end on a tip side, or shroud side, a line extending from the inlet to the outlet along a shroud-side edge of the turbine blade is a shroud line, and the shroud line includes a first shroud line that makes a large change from the inlet toward the outlet in a blade angle with respect to the axis of rotation, and a second shroud line that extends from the outlet side of the first shroud line to the outlet and makes a smaller change than that of the first shroud line.

According to such a configuration, it is possible to make the change in the blade angle of the first shroud line greater than the change in the blade angle of the second shroud line. In other words, it is possible to make the change in the blade angle of the turbine blades on the first shroud line greater and make the change in the blade angle of the turbine blades on the second shroud line smaller. The change in the blade angle of the turbine blades on the second shroud line can thus be reduced to make the second shroud line close to a straight line, whereby an increase in the flow velocity of the working fluid flowing over the suction surfaces on the shroud side of the turbine blades can be suppressed. Consequently, it is possible to suppress a drop in pressure on the suction surfaces on the shroud side of the turbine blades. This can reduce a difference in pressure between the pressure surfaces and the suction surfaces, and suppress leakage of the working fluid through the clearance between the turbine blades and the shroud.

Advantageously, in the turbine rotor, the first shroud line has a length of 10% to 20% of the shroud line, and the second shroud line has a length of 80% to 90% of the shroud line, which is equal to the length obtained by subtracting the length of the first shroud line from the length of the shroud line.

According to such a configuration, 10% to 20% of the length of the shroud line can be made into the first shroud line and 80% to 90% into the second shroud line. This can make the length of the first shroud line smaller than that of the second shroud line. Since the second shroud line can be increased in length, it is possible to make the second shroud line of the turbine blades even closer to a straight line.

Advantageously, in the turbine rotor, the second shroud line has a blade turning angle, which is an amount of change in the blade angle, of 30° or less.

According to such a configuration, the blade turning angle of the second shroud line is set to 30° or less. This can suitably suppress an increase in the flow velocity of the working fluid flowing over the suction surfaces on the shroud side of the turbine blades.

Advantageously, in the turbine rotor, the shroud line includes the first shroud line including an entrance-side shroud line which is a shroud line on the inlet side, and the second shroud line including a center shroud line and an exit-side shroud line that extend from the outlet side of the entrance-side shroud line to the outlet, and in a meridional cross section that is a cross section including the axis of rotation of the hub, the entrance-side shroud line has a curvature smaller than those of the center and exit-side shroud lines.

According to such a configuration, it is possible to make the curvature of the entrance-side shroud line smaller than those of the center and exit-side shroud lines. Since the center and exit-side shroud lines can be made greater in curvature, it is possible to suppress an increase in the flow velocity of the working fluid on the suction surface side of the shroud side. Consequently, it is possible to suppress a drop in pressure on the suction surfaces on the shroud side of the turbine blades, and suppress leakage of the working fluid through the clearance between the turbine blades and the shroud. Note that the flow channels of the working fluid, which extend from the inlet to the outlet, are formed between the turbine blades, the flow channels make a turn in flowing direction from a radial direction to an axial direction via a turning point, and the length of the entrance-side shroud line is from the inlet to the turning point.

Advantageously, in the turbine rotor, the entrance-side shroud line is formed in an R shape, and the center and exit-side shroud lines are formed in a straight shape.

According to such a configuration, the entrance-side shroud line can be formed in an R shape, and the center and exit-side shroud lines can be made in a straight shape. This can further suppress a drop in pressure on the suction surfaces on the shroud side of the turbine blades.

Advantageously, in the turbine rotor, an inlet line which is a line along an inlet-side edge of each of the turbine blades tilts in a direction of rotation with respect to the axis of rotation.

According to such a configuration, it is possible to direct the inflowing working fluid from the inlet toward the hub side. This can suppress a concentrated flow of the working fluid toward the shroud side. It is therefore possible to suppress a flow of the working fluid into the clearance between the turbine blades and the shroud, whereby leakage of the working fluid through the clearance can be suppressed.

Advantageously, in the turbine rotor, the inlet line has a tilt angle of 10° to 25° with respect to the axis of rotation.

According to such a configuration, the inlet line can be set to a suitable tilt angle. It is therefore possible to suppress leakage of the working fluid appropriately.

According to still another aspect of the present invention, a turbine rotor of a turbine that makes a working fluid flowing into in a radial direction through an inlet flow out in an axial direction through an outlet, includes: a hub that is rotatable about an axis of rotation; and a plurality of turbine blades that are arranged on a peripheral surface of the hub, and receive and direct the inflowing working fluid from the inlet toward the outlet. The turbine blades each are connected to the hub at a bottom side, or hub side, and have a free end on a tip side, or shroud side, a line along a shroud-side edge of the turbine blade is a shroud line, the shroud line includes an entrance-side shroud line that constitutes a shroud line on the inlet side, and a center shroud line and an exit-side shroud line that extend from the outlet side of the entrance-side shroud line to the outlet, and in a meridional cross section that is a cross section including the axis of rotation of the hub, the entrance-side shroud line has a curvature smaller than those of the center and exit-side shroud lines.

According to such a configuration, it is possible to make the curvature of the entrance-side shroud line smaller than those of the center and exit-side shroud lines. Since the center and exit-side shroud lines can be made greater in curvature, it is possible to suppress an increase in the flow velocity of the working fluid on the suction surface side of the shroud side. Consequently, it is possible to suppress a drop in pressure on the suction surfaces on the shroud side of the turbine blades, and suppress leakage of the working fluid through the clearance between the turbine blades and the shroud.

According to still another aspect of the present invention, a turbine rotor of a turbine that makes a working fluid flowing into in a radial direction through an inlet flow out in an axial direction through an outlet, includes: a hub that is rotatable about an axis of rotation; and a plurality of turbine blades that are arranged on a peripheral surface of the hub, and receive and direct the inflowing working fluid from the inlet toward the outlet. An inlet line tilts in a direction of rotation with respect to the axis of rotation, the inlet line being a line along the inlet-side edge of each of the turbine blades.

According to such a configuration, it is possible to direct the inflowing working fluid from the inlet toward the hub side. This can suppress a concentrated flow of the working fluid toward the shroud side. It is therefore possible to suppress a flow of the working fluid into the clearance between the turbine blades and the shroud, whereby leakage of the working fluid through the clearance can be suppressed.

Advantageous Effects of Invention

According to the turbine rotor of the present invention, it is possible to form the turbine blades in a suitable shape for improved turbine performance.

DESCRIPTION OF EMBODIMENTS

The turbine rotor according to the present invention will be described below with reference to the accompanying drawings. It should be noted that the present invention is not limited by these embodiments. The following embodiments may include components that are interchangeable by and easy to those skilled in the art, or substantially same ones.

[First Embodiment]

Figure 1:
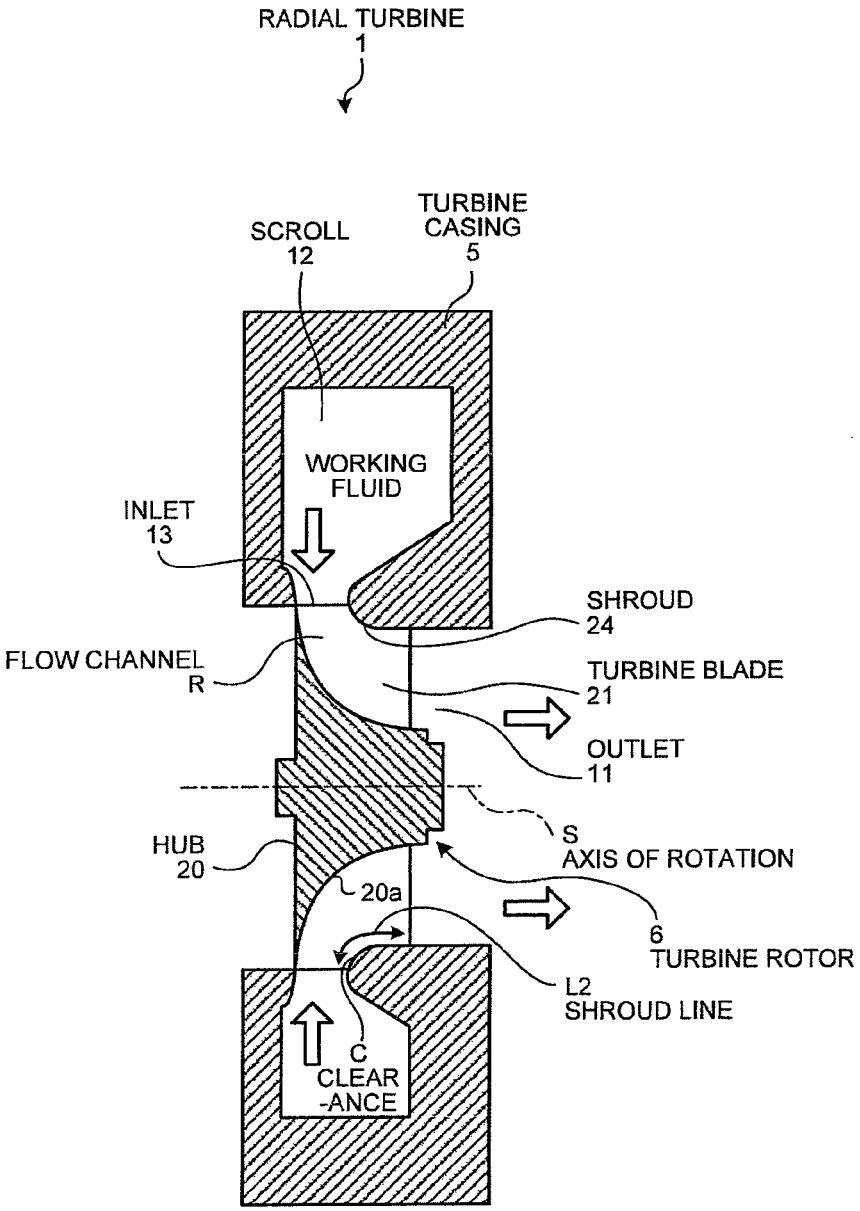
FIG. 1 is a meridional cross sectional view schematically showing a radial turbine that includes a turbine rotor according to a first embodiment.

As shown in FIG. 1, a turbine rotor 6 constitutes a part of a radial turbine 1. The radial turbine 1 is composed of a turbine casing 5 which serves as the outer shell, and the turbine rotor 6 which is arranged inside the turbine casing 5.

The turbine casing 5 has an outlet 11 which is formed in the axial direction of the axis of rotation S of the turbine rotor 6 arranged in the center. A spiral scroll 12 is formed in the circumferential direction outside the turbine rotor 6. A working fluid flowing through the scroll 12 radially flows into the turbine rotor 6 through an inlet 13 which is formed between the scroll 12 and the turbine rotor 6. The working fluid passes the turbine rotor 6 and flows out from the outlet 11.

The turbine rotor 6 has a hub 20 which rotates about the axis of rotation S, and a plurality of turbine blades 21 which are formed on the peripheral surface of the hub 20 and arranged radially from the axial center. The turbine rotor 6 is configured to receive the inflowing working fluid with the plurality of turbine blades 21 for rotation.

Here, the turbine casing 5 has a shroud 24 which is opposed to the turbine blades 21 of the turbine rotor 6. The shroud 24, the hub 20, and each turbine blade 21 define a flow channel R for the working fluid to flow through.

Each turbine blade 21 is connected to the peripheral surface of the hub 20 (hub surface 20*a*) at fixed end side (bottom side), or hub side, and adjoins the shroud at a free end side (tip side), or shroud side. As shown in FIG. 1, a line extending from the inlet 13 to the outlet 11 along the shroud-side edge of the turbine blade 21 will be referred to as a shroud line L2. A line extending from the inlet 13 to the outlet 11 along the hub-side edge of the turbine blade 21 will be referred to as a hub line H2. Here, the turbine blades 21 and the shroud 24 have a clearance C formed therebetween so as to allow rotation of the turbine rotor 6.

Consequently, when the working fluid flows in through the inlet 13 in the radial direction of the turbine rotor 6, the inflowing working fluid passes the flow channels R and each turbine blade 21 receives the inflowing working fluid for rotation. Here, the camber surface of either one of the turbine blades 21 that constitute a flow channel R serves as a pressure surface 21*a*. The camber surface of the other turbine blade 21 serves as a suction surface 21*b*. In other words, either one of the camber surfaces of each turbine blade 21 serves as a pressure surface 21*a*, and the other camber surface serves as a suction surface 21*b*. The working fluid past the flow channels R flows out from the outlet 11.

Figure 2:
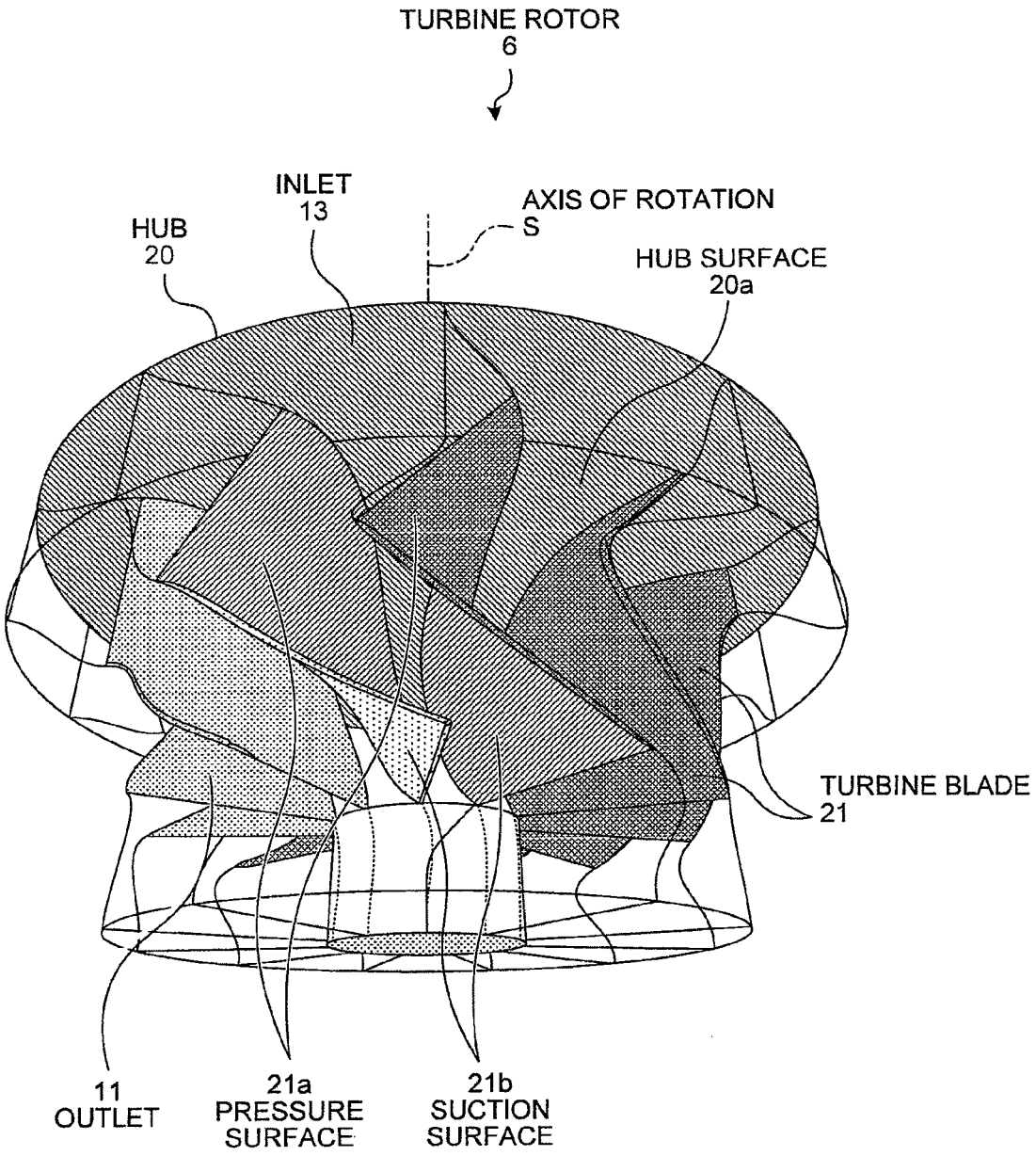
FIG. 2 is an external perspective view of the turbine rotor according to the first embodiment.
Figure 3:
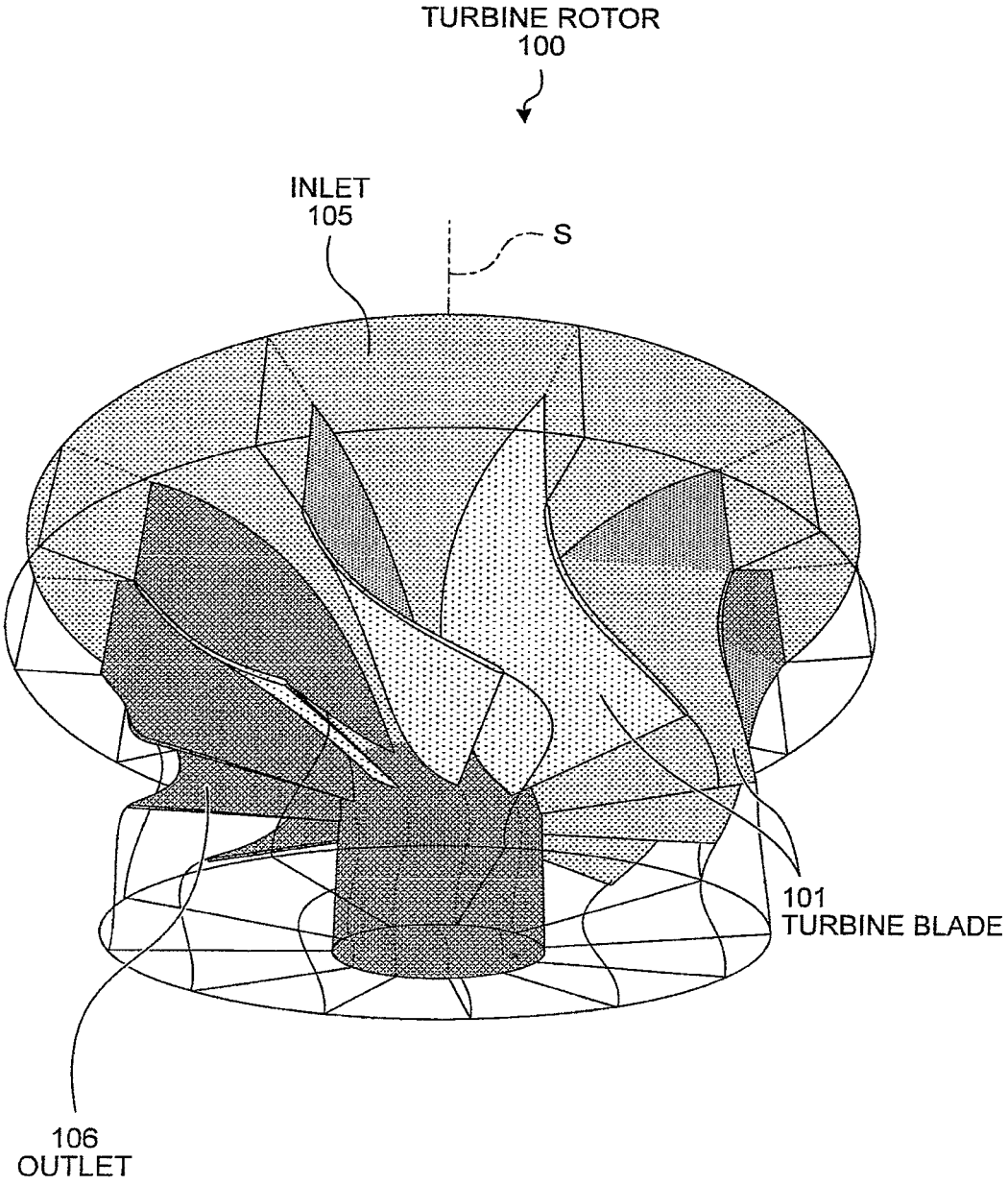
FIG.3 RELATED ART
FIG. 3 is an external perspective view of a conventional turbine rotor.

Now, the turbine blades 21 of the turbine rotor 6 of the first embodiment will be described with reference to FIG. 2. Turbine blades 101 of a conventional turbine rotor 10 will be described with reference to FIG. 3. Moreover, referring to FIGS. 4 and 5, the shape of the turbine blades 101 of the conventional turbine rotor 100 and the shape of the turbine blades 21 of the turbine rotor 6 of the first embodiment will be compared in an indirect fashion through the intermediary of the shape of turbine blades 32 of a turbine rotor 30 of a second embodiment to be described later. Hereinafter, characteristic portions of the turbine blades 21 of the turbine rotor 6 of the first embodiment will be described.

Figure 4:
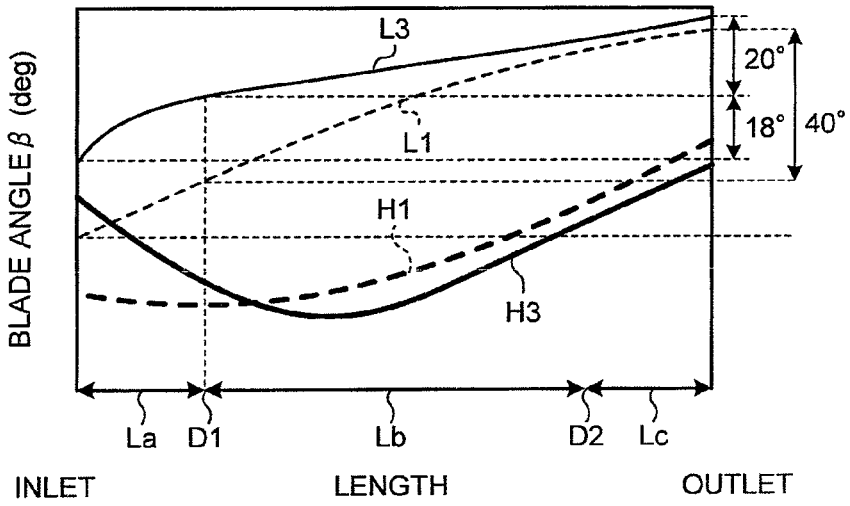
FIG. 4 is a graph related to the distribution of blade angles of turbine blades on shroud lines and hub lines of the conventional turbine rotor and a turbine rotor of a second embodiment.
Figure 5:
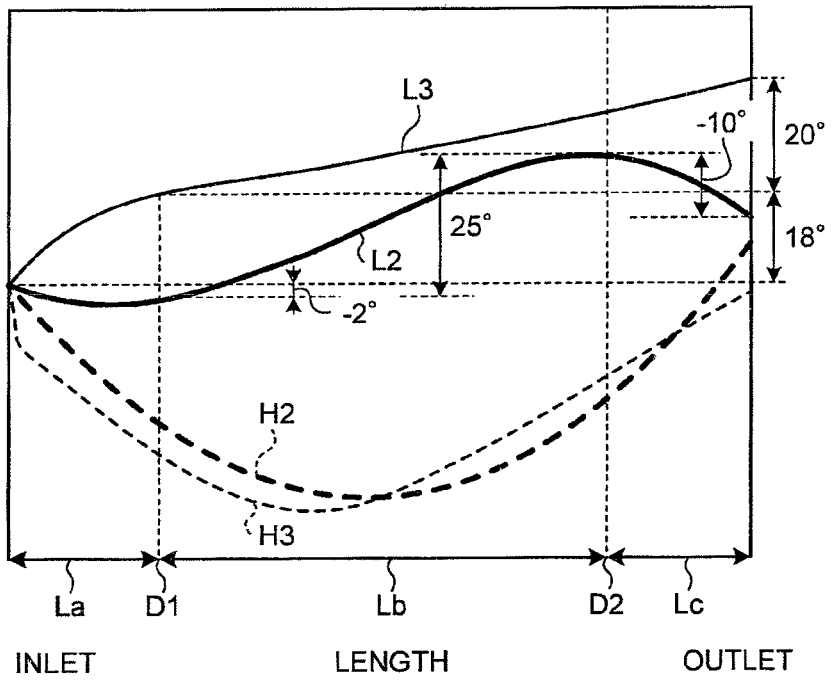
FIG. 5 is a graph related to the distribution of blade angles of turbine blades on shroud lines and hub lines of the turbine rotor of the first embodiment and the turbine rotor of the second embodiment.

FIG. 4 shows a shroud line L1 and a hub line H1 of the conventional turbine blades 101, and a shroud line L3 and a hub line H3 of the turbine blades 32 of the second embodiment. FIG. 5 shows the shroud line L2 and hub line H2 of the turbine blades 21 of the first embodiment, and the shroud line L3 and hub line H3 of the turbine blades 32 of the second embodiment.

The conventional turbine blades 101 are such that changes in the tilt angle (blade angle β) of a shroud line L1 from the inlet 105 to the outlet 106 with respect to the axis of rotation S increase gradually. Next, the turbine blades 32 of the second embodiment are such that changes in the tilt angle (blade angle β) of a shroud line L3 from the inlet 34 to the outlet 35 with respect to the axis of rotation S are greater on the side of the inlet 34 and smaller in the center and on the side of the outlet 35. Then, the turbine blades 21 of the first embodiment are such that changes in the tilt angle (blade angle β) of a shroud line L2 from the inlet 13 to the outlet 11 with respect to the axis of rotation S are smaller on the side of the inlet 13, greater in the center, and smaller on the side of the outlet 11.

Meanwhile, the conventional turbine blades 101 are such that the tilt angle (blade angle β) of a hub line H1 from the inlet 105 to the outlet 106 with respect to the axis of rotation S is generally flat on the side of the inlet 105 and gradually increases in the center and on the side of the outlet 106. Next, the turbine blades 32 of the second embodiment are such that the tilt angle (blade angle β) of a hub line H3 with respect to the axis of rotation S decreases from the side of the inlet 34 to the center and increases from the center to the side of the outlet 35. As with the second embodiment, the turbine blades 21 of the first embodiment are such that the tilt angle (blade angle β) of a hub line H2 with respect to the axis of rotation S decreases from the side of the inlet 13 to the center, and increases from the center to the outlet 11.

The blade angle β of the shroud line L1 of the conventional turbine blades 101 and the blade angle β of the shroud line L2 of the turbine blades 21 of the first embodiment will be specifically described with reference to FIGS. 4 and 5. On the graphs shown in FIGS. 4 and 5, the horizontal axis indicates the length of the shroud line from the inlet 13 or 105 to the outlet 11 or 106 in a meridional cross section (a cross section that includes the axis of rotation S). The vertical axis indicates the blade angle β.

Here, the shroud lines L1 and L2 are composed of an entrance-side shroud line La (first shroud line) on the side of the inlet 13 or 105, an exit-side shroud line Lc (third shroud line) on the side of the outlet 11 or 106, and a center shroud line Lb (second shroud line) between the entrance-side shroud line La and the exit-side shroud line Lc. Specifically, the flow channel R of working fluid extending from the inlet 13 or 105 to the outlet 11 or 106 makes a turn in flowing direction from a radial direction to an axial direction via a turning position D1. The length of the entrance-side shroud line La is from the inlet 13 or 105 to the turning position (turning point) D1. The length of the center shroud line Lb is from the turning position D1 to a predetermined position D2 that is a predetermined length away. The length of the exit-side shroud line Lc is from the predetermined position D2 to the outlet 11 or 106.

The entrance-side shroud line La has a length that is about 20% that of the shroud line L1 or L2. The center shroud line Lb has a length that is about 60% that of the shroud line L1 or L2. The exit-side shroud line Lc has a length that is about 20% that of the shroud line L1 or L2.

Referring to the graph of FIG. 4, the conventional turbine blades 101 are such that the change in the blade angle β decreases at a generally constant rate from the inlet 105 to the outlet 106 of the shroud line L1. That is, the blade angle β on the shroud side of the conventional turbine blades 101 gradually tilts with respect to the axis of rotation S with a decreasing distance to the outlet 106. Specifically, the blade turning angle Δβ per unit length of the entrance-side shroud line La of the shroud line L1 is generally the same as the blade turning angle Δβ per unit length of the center and exit-side shroud lines Lb. Here, the blade turning angle Δβ refers to the amount of change in the blade angle β. The conventional turbine blades 101 have a blade turning angle Δβ of approximately 40° on the center and exit-side shroud lines Lb.

Now, referring to the graph of FIG. 5, the turbine blades 21 of the first embodiment are such that the blade angle β of the entrance-side shroud line La of the shroud line L2 makes a small change to decrease, the blade angle β of the center shroud line Lb makes a large change to increase, and the blade angle β of the exit-side shroud line Lc makes a small change to decrease. That is, the blade angle β on the shroud side of the turbine blades 21 of the first embodiment tilts so that the tilt angle with respect to the axis of rotation S decreases from the inlet 13 to the turning position D1. The blade angle β tilts so that the tilt angle with respect to the axis of rotation S increases from the turning position D1 to the predetermined position D2. The blade angle β tilts so that the tilt angle with respect to the axis of rotation decreases from the predetermined position D2 to the outlet 11. Specifically, the blade turning angle Δβ per unit length of the center shroud line Lb is greater than the blade turning angles Δβ per unit length of the entrance-side shroud line La and the exit-side shroud line Lc. In this regard, the turbine blades 21 of the first embodiment are configured so that the entrance-side shroud line La has a blade turning angle Δβ of approximately −2°, the center shroud line Lb has a blade turning angle Δβ of approximately 25°, and the exit-side shroud line Lc has a blade turning angle Δβ of approximately −10°.

According to the foregoing configuration, the blade angle β of the entrance-side shroud line La of the turbine rotor 6 of the first embodiment can be configured to make a small change on the entrance-side shroud line La, a large change on the center shroud line Lb, and a small change on the exit-side shroud line Lc. As a result, it is possible to suppress an increase in the flow velocity of the working fluid on the shroud side of the suction surfaces 21*b* of the turbine blades 21, and suppress a drop in pressure on the suction surfaces 21*b* (details will be given later). It is therefore possible to suppress differences in pressure between the pressure surfaces 21*a* and the suction surfaces 21*b* of the turbine blades 21, and suppress leakage of the working fluid through the clearance C between the turbine blades 21 and the shroud 24. As a result, it is possible to suppress a drop in turbine efficiency due to the leakage of the working fluid.

[Second Embodiment]

Figure 6:
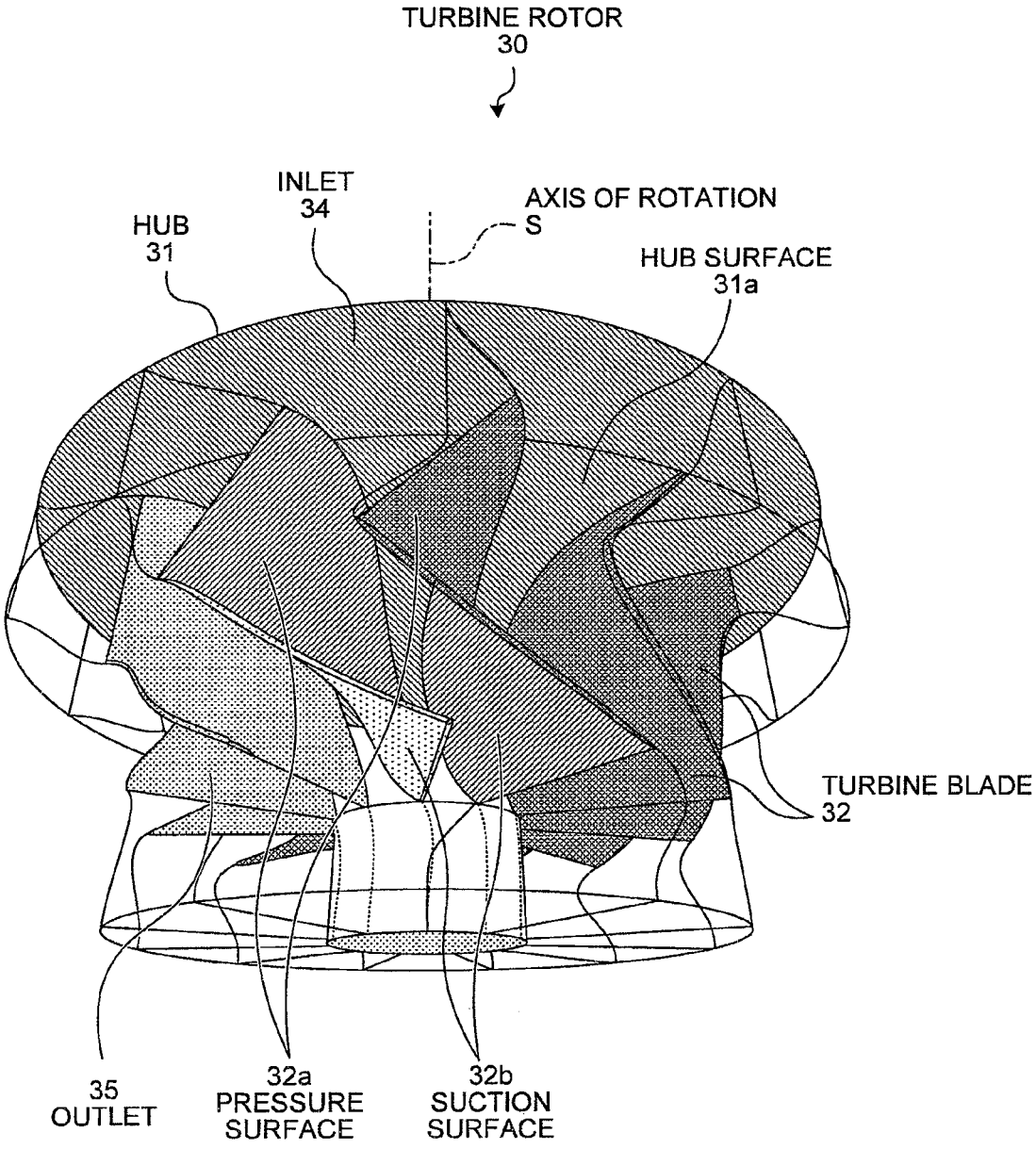
FIG. 6 is an external perspective view of the turbine rotor according to the second embodiment.

Next, the turbine rotor 30 according to the second embodiment will be described with reference to FIG. 6. To avoid redundancy, the following description deals only with differences. As shown in FIG. 6, the turbine rotor 30 of the second embodiment is configured generally the same as that of the first embodiment. The turbine rotor 30 has a hub 31 which rotates about the axis of rotation S, and a plurality of turbine blades 32 which are formed on the peripheral surface of the hub 31 and arranged radially from the axial center. The turbine rotor 30 is configured to receive the inflowing working fluid with the plurality of turbine blades 32 for rotation.

Here, the turbine blades 32 of the turbine rotor 30 of the second embodiment have a shroud line L3 of different shape than the shroud line L2 of the turbine blades 21 of the first embodiment. Referring to FIGS. 4 and 5, the blade angle β of the shroud line L1 of the conventional turbine blades 101 and the blade angle β of the shroud line L3 of the turbine blades 32 of the second embodiment will be described below.

As has been described in the first embodiment, the shroud lines L1 and L3 are composed of an entrance-side shroud line La on the side of the inlet 34 or 105, an exit-side shroud line Lc on the side of the outlet 35 or 106, and a center shroud line Lb between the entrance-side shroud line La and the exit-side shroud line Lc. The entrance-side shroud line La has a length that is about 20% that of the shroud line L1 or L3. The center shroud line Lb has a length that is about 60% that of the shroud line L1 or L3. The exit-side shroud line Lc has a length that is about 20% that of the shroud line L1 or L3.

Now, referring to the graph of FIG. 5, the turbine blades 32 of the second embodiment are such that the blade angle β of the entrance-side shroud line La of the shroud line L3 makes a large change to increase. The blade angle β of the center shroud line Lb and the exit-side shroud line Lc makes a small change to increase. That is, the blade angle β on the shroud side of the turbine blades 32 of the second embodiment tilts so that the tilt angle with respect to the axis of rotation S greatly increases from the inlet 34 to the turning position D1. The blade angle β tilts so that the tilt angle with respect to the axis of rotation S gently increases from the turning position D1 to the outlet 11 via the predetermined position D2. Specifically, the blade turning angle Δβ per unit length of the entrance-side shroud line La is greater than the blade turning angle Δβ per unit length of the center shroud line Lb and the exit-side shroud line Lc. In this regard, the turbine blades 32 of the second embodiment are configured such that the entrance-side shroud line La has a blade turning angle Δβ of approximately 18°, and the center shroud line Lb and the exit-side shroud line Lc have a blade turning angle Δβ of approximately 20°. Consequently, in the case of the turbine blades 32 of the second embodiment, the entrance-side shroud line La corresponds to a first shroud line, and the center shroud line Lb and the exit-side shroud line Lc correspond to a second shroud line.

Figure 7:
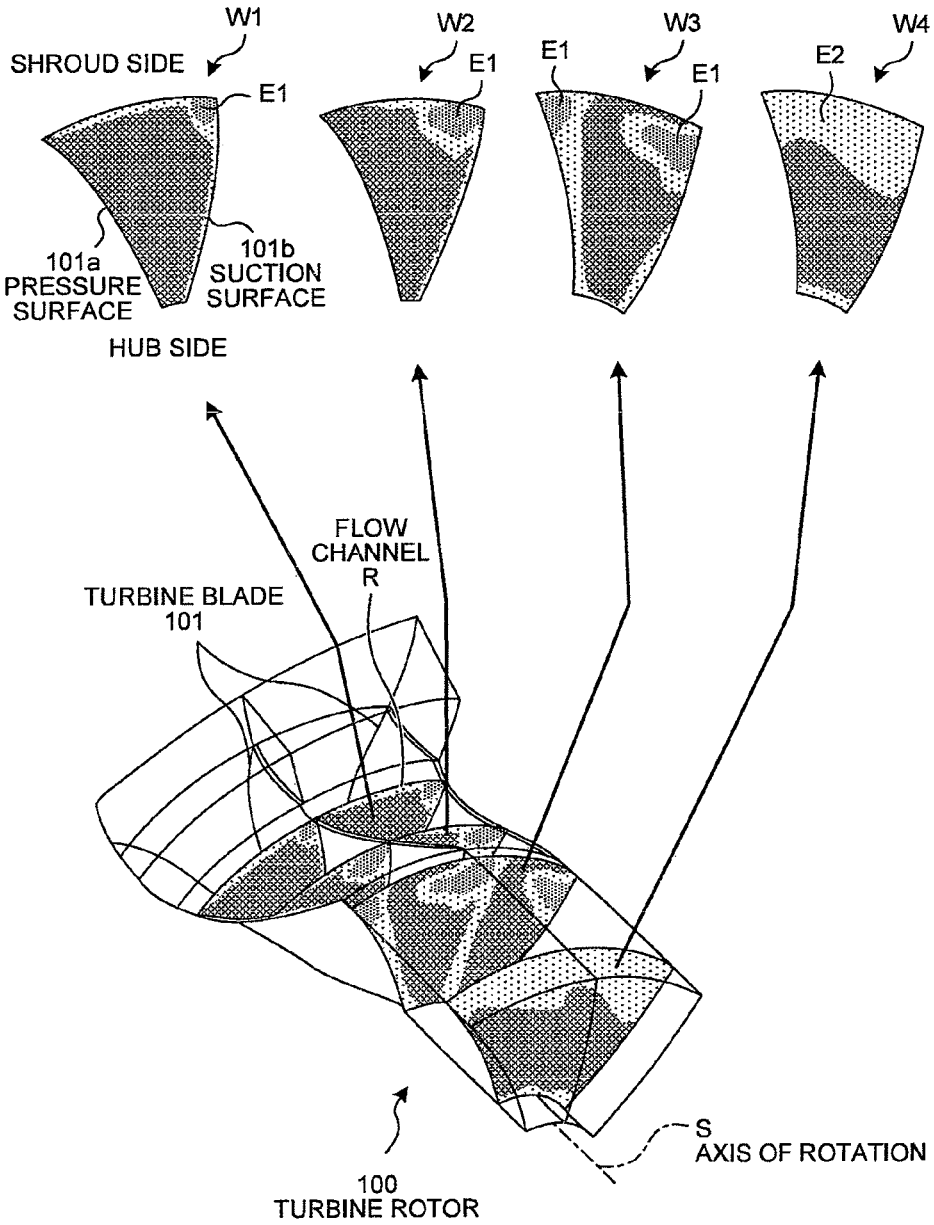
FIG. 7 is a distribution chart of turbine efficiencies in a flow channel of the conventional turbine rotor.
Figure 8:
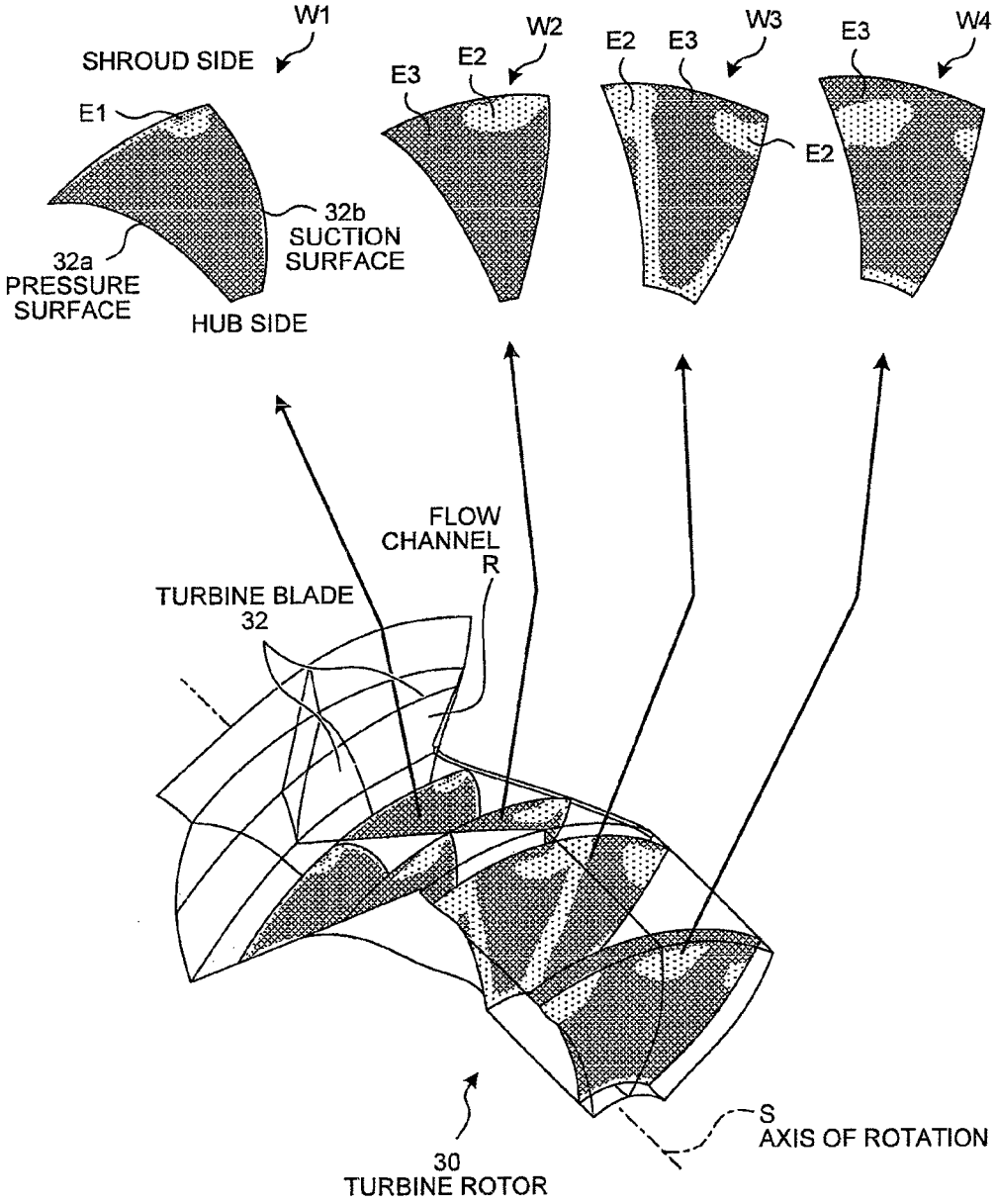
FIG. 8 is a distribution chart of turbine efficiencies in a flow channel of the turbine rotor according to the second embodiment.

Next, referring to FIGS. 7 and 8, the performance of a radial turbine having the conventional turbine rotor 100 of the foregoing configuration will be compared with the performance of a radial turbine having the turbine rotor 30 of the second embodiment. FIG. 7 shows four distribution charts of turbine efficiencies of the conventional turbine rotor 100 along the flowing direction of working fluid flowing in a flow channel R, the distribution charts being taken along cross sections of the flow channel R perpendicular to the axial direction of the axis of rotation S. Of the four distribution charts of turbine efficiencies, the first chart from the left in the diagram is a first distribution chart W1 of turbine efficiencies at the inlet 105. The third chart from the left in the diagram is a third distribution chart W3 of turbine efficiencies at the outlet 106. The second chart from the left in the diagram is a second distribution chart W2 of turbine efficiencies between the inlet 105 and the outlet 106. The fourth chart from the left in the diagram is a fourth distribution chart W4 on a far downstream side past the blades.

Referring to the first distribution chart W1, with regard to the turbine efficiency, a low efficiency area E1 where the efficiency is low is formed on the shroud side of the suction surface 101*b*. In the second distribution chart W2, with regard to the turbine efficiency, a low efficiency area E1 of greater size than in the first distribution chart W1 is formed on the shroud side of the suction surface 101*b*. In the third distribution chart W3, with regard to the turbine efficiency, a low efficiency area E1 is also formed on the shroud side of the pressure surface 101*a*. In the fourth distribution chart W4, with regard to the turbine efficiency, an intermediate efficiency area E2 where the efficiency is higher than in the low efficiency area E1 is formed on the shroud side between the pressure surface 101*a* and the suction surface 101*b*.

Now, FIG. 8 shows four distribution charts of turbine efficiencies of the turbine rotor 30 of the second embodiment along the flowing direction of working fluid flowing in a flow channel R, the distribution charts being taken along cross sections of the flow channel R perpendicular to the axial direction of the axis of rotation S. Like FIG. 7, the first chart from the left in FIG. 8 is a first distribution chart W1 of turbine efficiencies at the inlet 13. The third chart from the left in the diagram is a third distribution chart W3 of turbine efficiencies at the outlet 11. The second chart from the left in the diagram is a second distribution chart W2 of turbine efficiencies between the inlet 34 and the outlet 35. The fourth chart from the left in the diagram is a fourth distribution chart W4 on a far downstream side past the blades.

Referring to the first distribution chart W1, with regard to the turbine efficiency, a small low efficiency area E1 is formed on the shroud side of the suction surface 32*b*. It can be seen that the low efficiency area E1 is smaller than in the conventional turbine rotor 100 shown in FIG. 7. In the second distribution chart W2, with regard to the turbine efficiency, an intermediate efficiency area E2 is formed on the shroud side of the suction surface 32*b*. In the third distribution chart W3, with regard to the turbine efficiency, an intermediate efficiency area E2 is formed on the shroud side of the pressure surface 32*a*. In the fourth distribution chart W4, with regard to the turbine efficiency, a high efficiency area E3 where the efficiency is higher than in the intermediate area E2 is formed almost across the entire section without a low efficiency area E1 or intermediate efficiency area E2. It can be seen that the turbine rotor 30 of the second embodiment is more efficient than the conventional turbine rotor 100.

Figure 9:
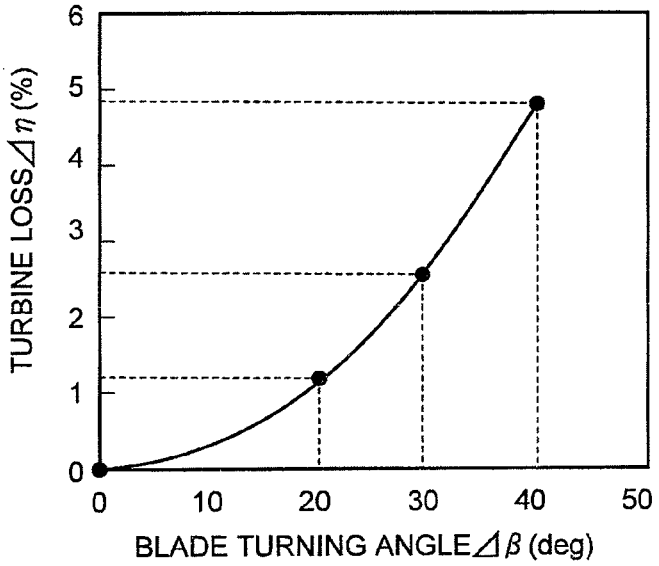
FIG. 9 is a graph related to a loss in turbine efficiency that varies with the blade turning angle of the turbine rotor according to the second embodiment.

Next, referring to FIG. 9, a description will be given of the turbine efficiency which varies with the blade turning angle Δβ of the turbine blades 32 of the turbine rotor 32 of the second embodiment. In FIG. 9, the vertical axis indicates the loss rate Δη of the turbine efficiency. The horizontal axis indicates the blade turning angle Δβ of the center and exit-side shroud lines Lb and Lc. As shown in FIG. 9, it can be seen that the loss of the turbine efficiency increases as the blade turning angle Δβ of the center and exit-side shroud lines Lb and Lc increases. The blade turning angle Δβ can thus be reduced in angle to suppress the loss of the turbine efficiency.

Here, the conventional turbine rotor 100 has a blade turning angle Δβ of 40°, and the turbine rotor 6 of the second embodiment has a blade turning angle Δβ of 20°. At a blade turning angle Δβ of 30°, the loss of the turbine efficiency can be reduced by half as compared to that of the conventional turbine efficiency. Blade turning angles Δβ of 30° and less therefore allow sufficient suppression of the efficiency loss of the radial turbine 1.

With the foregoing configuration, it is possible to make the blade turning angle Δβ per unit length of the center and exit-side shroud lines Lb and Lc of the turbine rotor 30 of the second embodiment smaller as compared to the conventional configuration. This can make the turbine blades 32 almost straight in the center and exit-side shroud lines Lb and Lc. As a result, it is possible to suppress an increase in the flow velocity of the working fluid on the shroud side of the suction surfaces 32*b* of the turbine blades 32, and suppress a drop in pressure on the suction surfaces 32*b* (details will be given later). Consequently, it is possible to suppress differences in pressure between the pressure surfaces 32*a* and the suction surfaces 32*b* of the turbine blades 32, and suppress leakage of the working fluid through the clearance C between the turbine blades 32 and the shroud 24. As a result, it is possible to suppress a drop in turbine efficiency due to the leakage of the working fluid.

Moreover, 20% of the length of the shroud line L3 may be the entrance-side shroud line La, and 80% thereof may be the center and exit-side shroud lines Lb and Lc. Since the center and exit-side shroud lines Lb and Lc can be increased in length, it is possible to make the center and exit-side shroud lines Lb and Lc of the turbine blades 32 close to a straight line. While in the second embodiment the entrance-side shroud line La occupies 20% of the length of the shroud line L3 and the center and exit-side shroud lines Lb and Lb occupy 80% thereof, the entrance-side shroud line La may be 10% of the length of the shroud line L and the center and exit-side shroud lines Lb and Lb may be 90% thereof.

Moreover, setting the blade turning angle $\Delta\beta$ on the center and exit-side shroud lines Lb and Lc to or below 30° can reduce the loss of the turbine efficiency to a half or less as compared to the conventional one.

[Third Embodiment]

Figure 10:
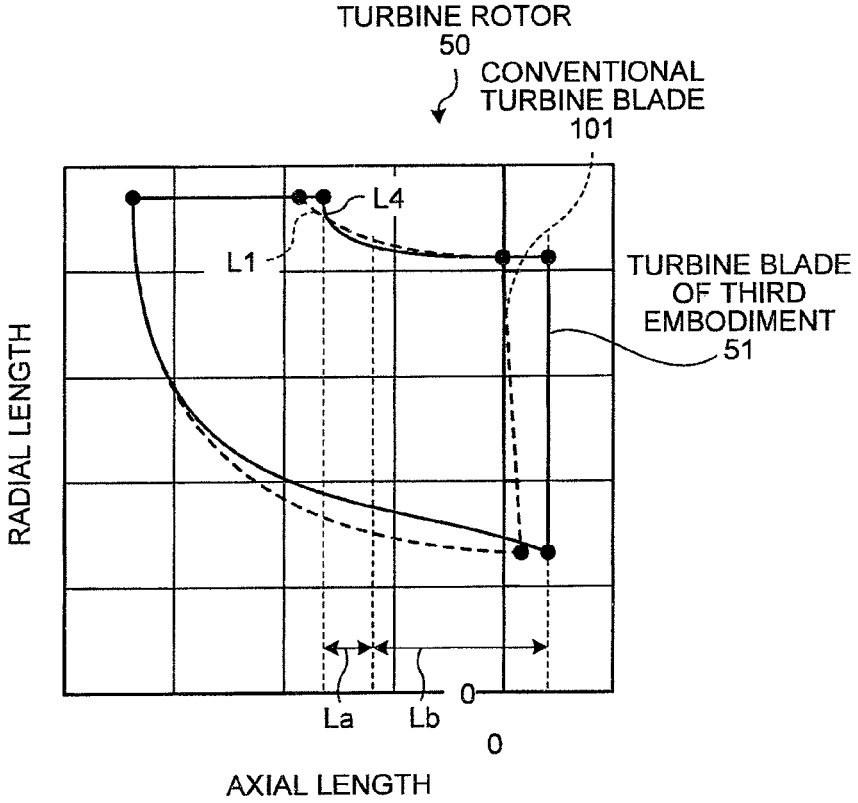
FIG. 10 is a meridional cross sectional view of turbine blades of a turbine rotor according to a third embodiment and the conventional turbine rotor.

Next, a turbine rotor 50 according to a third embodiment will be described with reference to FIG. 10. To avoid redundancy, the following description deals only with differences. FIG. 10 is a meridional cross sectional view of turbine blades 51 and 101 of the turbine rotor 50 according to the third embodiment and the conventional turbine rotor 100. The turbine blades 51 of the turbine rotor 50 of the third embodiment are formed so that, in a meridional cross section, the entrance-side shroud line La has a curved shape and the center and exit-side shroud lines Lb has an almost straight shape.

Specifically, referring to FIG. 10, the vertical axis indicates the radial length, and the horizontal axis indicates the axial length. The conventional turbine blades 101 are formed so that the shroud line L1 slopes downward. The turbine blades 51 of the third embodiment are formed so that the shroud line L4 includes an entrance-side shroud line La having a smaller curvature, and center and exit-side shroud lines Lb and Lc having a curvature greater than that of the entrance-side shroud line La. In the meridional cross section, the entrance-side shroud line La is 20% of the length of the shroud line L4. The center and exit-side shroud lines Lb and Lc are 80% of the length of the shroud line L4. The entrance-side shroud line La is thus formed in a curved shape, and the center and exit-side shroud lines Lb and Lc are formed in an almost straight shape.

According to the foregoing configuration, it is possible to make the curvature of the entrance-side shroud line La smaller than those of the center and exit-side shroud lines Lb and Lc. The curvatures of the center and exit-side shroud lines Lb and Lc can thus be increased to form the center and exit-side shroud lines Lb and Lc in an almost straight shape. This can suppress an increase in the flow velocity of the working fluid on the suction surfaces on the shroud side of the turbine blades 51. As a result, it is possible to suppress an increase in the flow velocity of the working fluid on the shroud side of the suction surfaces of the turbine blades 51, and suppress a drop in pressure on the suction surfaces (details will be given later). Consequently, it is possible to suppress differences in pressure between the pressure surfaces and the suction surfaces of the turbine blades 51, and suppress leakage of the working fluid through a clearance between the turbine blades 51 and the shroud 24. As a result, it is possible to suppress a drop in turbine efficiency due to the leakage of the working fluid.

It should be appreciated that the configuration of the third embodiment may be combined with the configuration of the first embodiment or the second embodiment, whereby a drop in turbine efficiency can be suitably suppressed.

[Fourth Embodiment]

Figure 11:
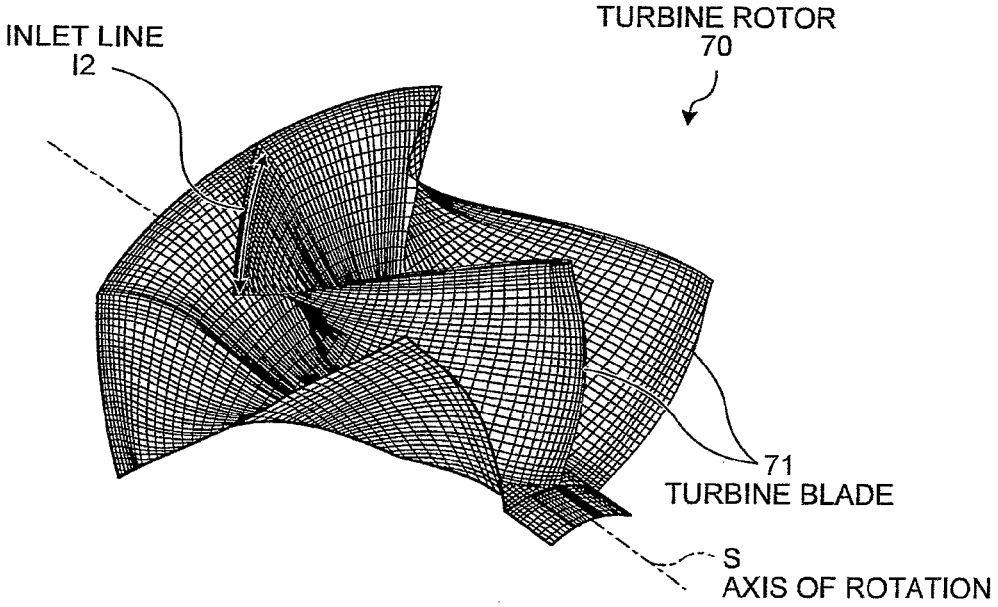
FIG. 11 is an external perspective view showing a part of a turbine rotor according to a fourth embodiment.
Figure 12:
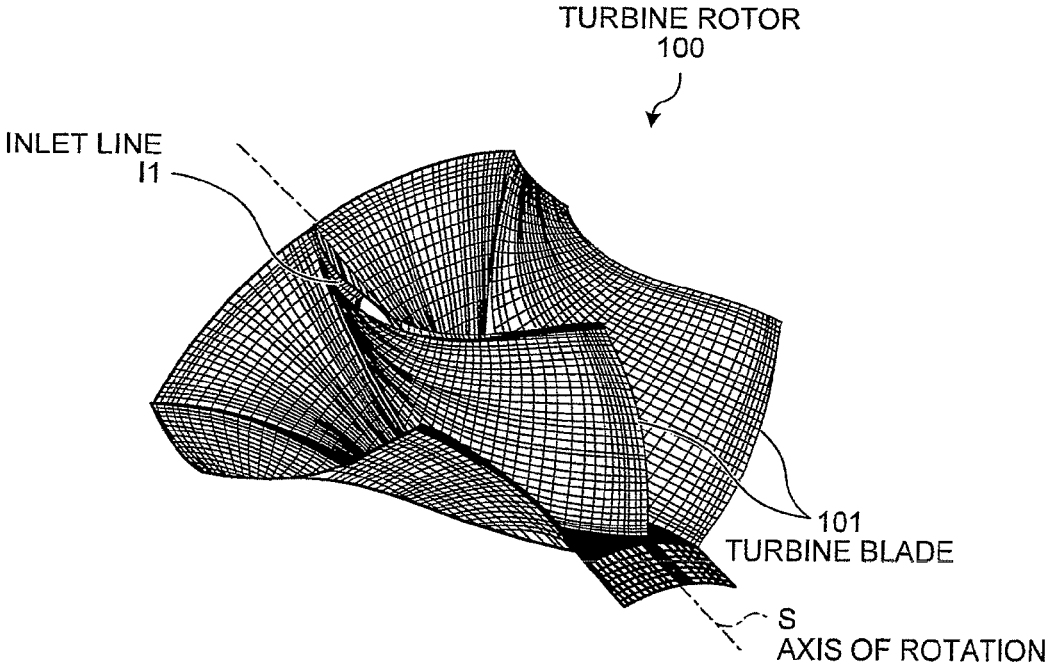
FIG.12 RELATED ART
FIG. 12 is an external perspective view showing a part of the conventional turbine rotor.
Figure 13:
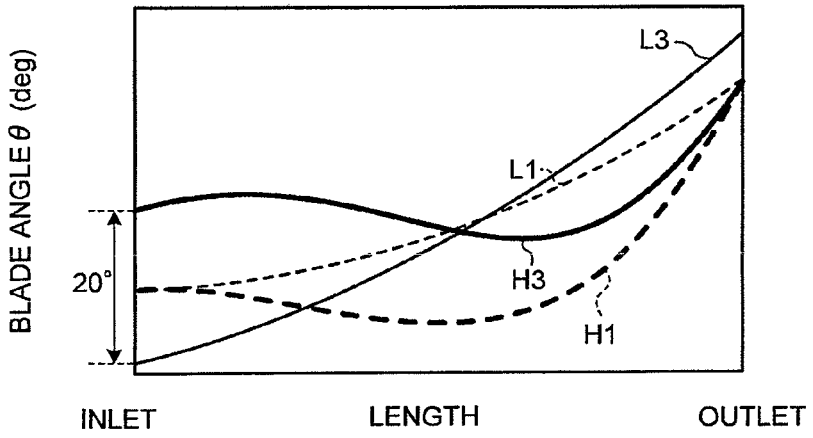
FIG. 13 is a graph related to the distributions of blade angles in the circumferential direction (θ direction) of a turbine blade of the second embodiment to which the configuration of the fourth embodiment is applied, and a conventional turbine blade, respectively.
Figure 14:
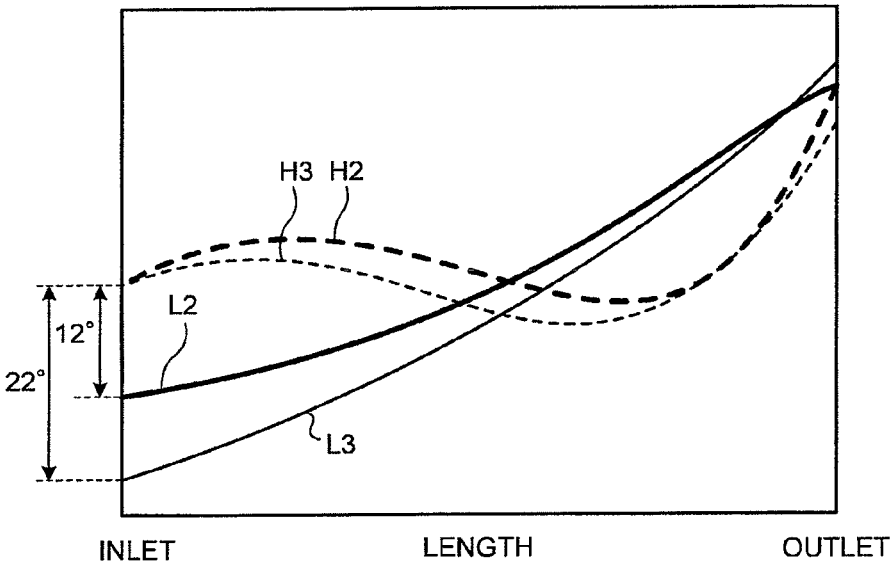
FIG. 14 is a graph related to the distributions of blade angles in the circumferential direction (θ direction) of a turbine blade of the first embodiment to which the configuration of the fourth embodiment is applied, and a turbine blade of the second embodiment to which the configuration of the fourth embodiment is applied, respectively.
Figure 15:
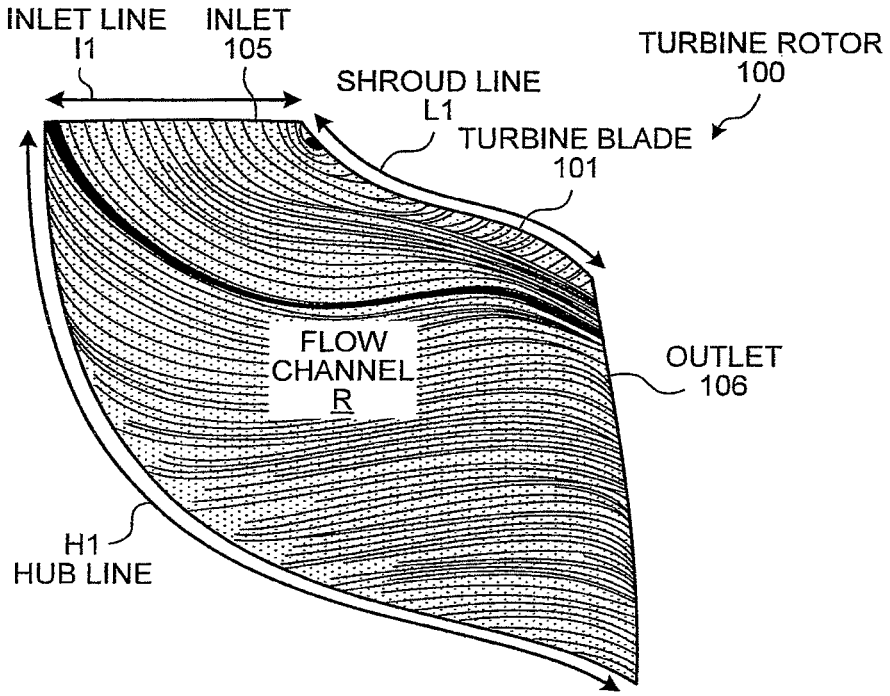
FIG.15 RELATED ART
FIG. 15 is a meridional cross sectional view showing the streamlines of working fluid in a flow channel of the conventional turbine rotor.
Figure 16:
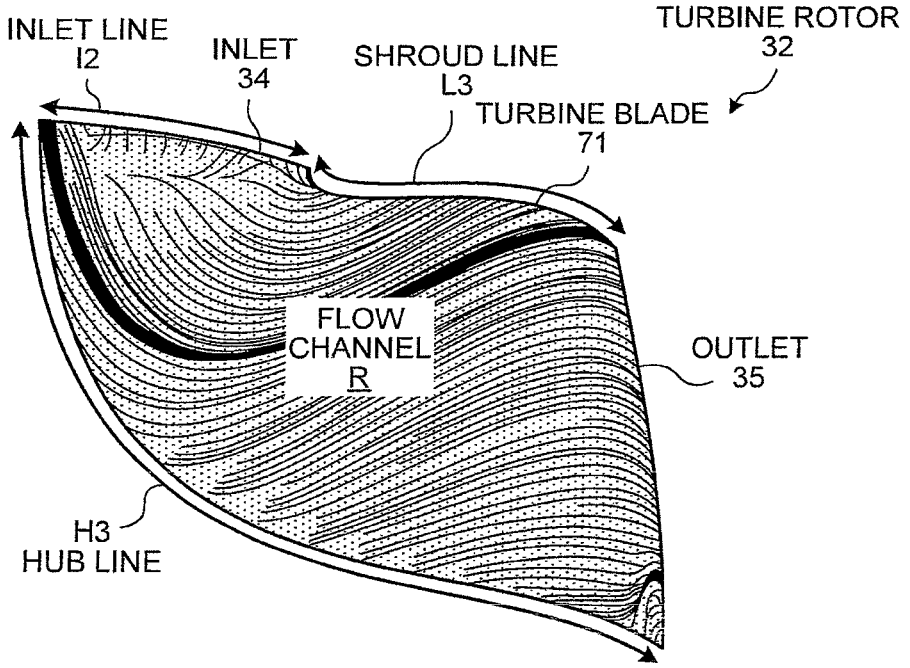
FIG. 16 is a meridional cross sectional view showing the streamlines of working fluid in a flow channel of the turbine rotor according to the fourth embodiment.

Finally, a turbine rotor 70 according to a fourth embodiment will be described with reference to FIGS. 11 to 16. Again, in order to avoid redundancy, the following description deals only with differences. FIG. 11 is an external perspective view showing a part of the turbine rotor 70 according to the fourth embodiment. FIG. 12 is an external perspective view showing a part of the conventional turbine rotor 100. FIG. 13 is a graph related to the distribution of blade angles θ of turbine blades in the circumferential direction (θ direction) when the configuration of turbine blades 71 of the fourth embodiment is applied to the turbine blades 32 of the second embodiment. Similarly, FIG. 14 is a graph related to the distribution of blade angles θ of turbine blades in the circumferential direction (θ direction) when the configuration of turbine blades 71 of the fourth embodiment is applied to the turbine blades 21 of the first embodiment. Moreover, FIG. 15 is a meridional cross sectional view showing the streamlines of the working fluid in the flow channel of the conventional turbine rotor. FIG. 16 is a meridional cross sectional view showing the streamlines of the working fluid in the flow channel of the turbine rotor 70 of the fourth embodiment. The turbine blades 71 of the turbine rotor 70 of the fourth embodiment have an inlet line I2, a line along the inlet-side edge, that tilts in the direction of rotation with respect to the axis of rotation S.

Specifically, as shown in FIG. 12, a conventional inlet line I1 is formed to lie generally in the same direction as that of the axis of rotation S. That is, as shown in FIG. 13, the circumferential angle (blade angle θ) of the shroud line L1 on the side of the inlet 105 and the circumferential angle (blade angle θ) of the hub line H1 on the side of the inlet 105 are the same as each other, being in the same phase in the circumferential direction. The conventional inlet line I1 extending from the inlet 105 of the hub line H1 to the inlet 105 of the shroud line L1 therefore makes no displacement in the circumferential direction and lies generally in the same direction as that of the axis of rotation S.

On the other hand, as shown in FIGS. 13 and 14, the turbine blades 32 of the second embodiment to which the configuration of the turbine blades 71 of the fourth embodiment is applied have the inlet line I2 such that the circumferential blade angle θ on the inlet side of the shroud line L3 of the second embodiment and the circumferential blade angle θ on the inlet side of the hub line H3 have an angular difference of around 20° to 22° therebetween, being in different phases in the circumferential direction. The inlet line I2 of the third embodiment extending from the inlet 34 of the hub line H3 to the inlet 34 of the shroud line L3 therefore makes a displacement in the circumferential direction (the direction of rotation), whereby the inlet line I2 is tilted in the direction of rotation with respect to the axis of rotation S.

Then, as shown in FIG. 14, the turbine blades 21 of the first embodiment to which the configuration of the turbine blades 71 of the fourth embodiment is applied have the inlet line I2 such that the circumferential blade angle θ on the inlet side of the shroud line L2 of the first embodiment and the circumferential blade angle θ on the inlet side of the hub line H2 have an angular difference of around 12° therebetween, being in different phases in the circumferential direction. The inlet line I2 of the first embodiment extending from the inlet 13 of the hub line H2 to the inlet 11 of the shroud line L2 therefore makes a displacement in the circumferential direction (the direction of rotation), whereby the inlet line I2 is tilted in the direction of rotation with respect to the axis of rotation S.

Next, referring to FIGS. 15 and 16, a comparison will be made between the flow of the working fluid flowing through the flow channel R of the conventional turbine rotor 100 and the flow of the working fluid flowing through the flow channel R of the turbine rotor 30 of the second embodiment to which the configuration of the turbine blades 71 of the foregoing fourth embodiment is applied.

Referring to FIG. 15, when the working fluid flows into the conventional turbine rotor 100 through the inlet 105, the inflowing working fluid from the shroud side of the inlet 105 flows along the shroud line L1. In the meantime, the inflowing working fluid from the hub side of the inlet 105 flows toward the shroud side, not along the hub line H1. As a result, the working fluid flowing through the flow channel R concentrates on the shroud side of the outlet 106. This facilitates the leakage of the working fluid through the clearance C between the shroud 24 and the turbine blades 101 at the outlet 106 on the shroud side.

Now, referring to FIG. 16, when the working fluid flows into the turbine rotor 32 of the second embodiment to which the configuration of the turbine blades 71 of the fourth embodiment is applied through the inlet 34, the inflowing working fluid from the shroud side of the inlet 34 flows along the shroud line L3. In the meantime, the inflowing working fluid from the hub side of the inlet 34 flows along the hub line H3 in the upstream side before flowing toward the shroud side. The working fluid flowing through the flow channel R thus flows toward the shroud side of the outlet 35, whereas the concentration of the working fluid on the shroud side of the outlet 35 can be suppressed as compared to the conventional one as much as the inflowing working fluid from the hub side of the inlet 35 flows along the hub line H3 in the upstream side.

According to such a configuration, it is possible to direct the working fluid flowing into through the inlet 35 toward the hub side. This can suppress flow of the working fluid toward the shroud side and into the clearance C between the turbine blades 32 and the shroud 24, whereby leakage of the working fluid through the clearance C can be suppressed.

The fourth embodiment has dealt with the case where the circumferential blade angles θ on the side of the inlets 13 and 34 of the shroud lines L2 and L3 and the circumferential blade angles θ on the side of the inlets 13 and 34 of the hub lines H2 and H3 have angular differences of 12° and 20°. However, the leakage of the working fluid can be suitably suppressed within the range of 10° to 25°.

Next, referring to FIGS. 17 to 20, a description will be given of the performance of radial turbines to which the turbine rotor 6, a combination of the first embedment with the fourth embodiment, and the turbine rotor 30, a combination of the second embodiment with the third and fourth embodiments, are applied, respectively. Drawings of such turbine rotors will be omitted.

Figure 17:
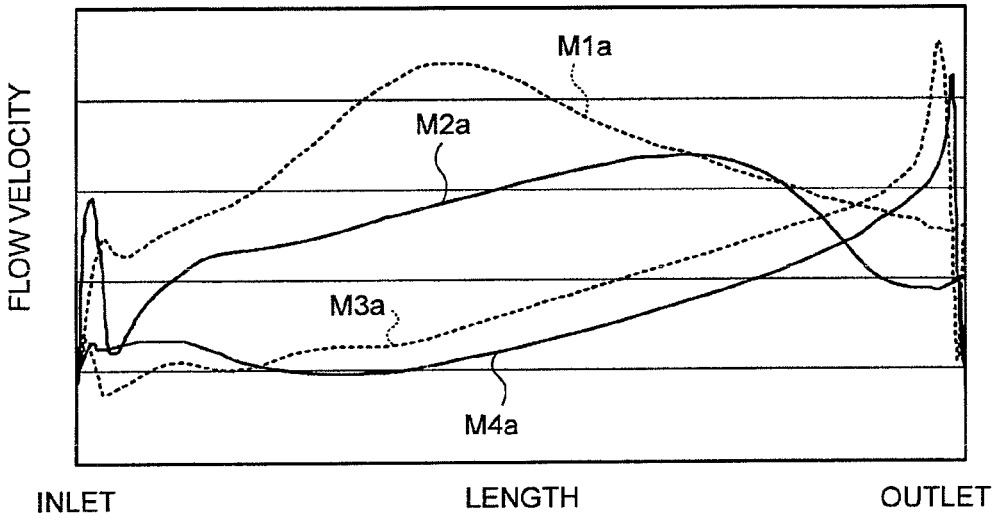
FIG. 17 is a graph showing changes in flow velocity on the pressure surfaces and suction surfaces on the shroud side of a conventional turbine blade and a turbine blade according to the first embodiment.
Figure 18:
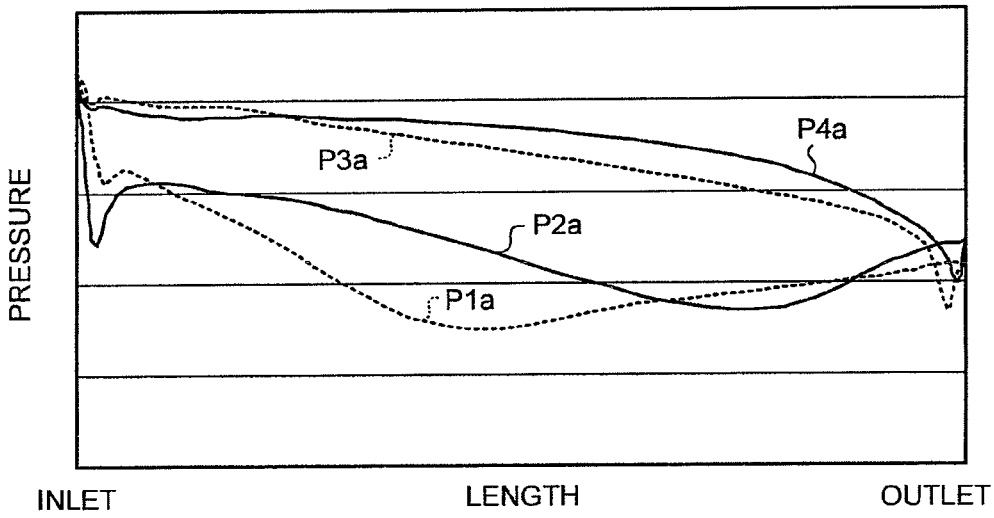
FIG. 18 is a graph showing changes in pressure on the pressure surfaces and suction surfaces on the shroud side of the conventional turbine blade and the turbine blade according to the first embodiment.

Initially, the turbine rotor 6 which combines the first embodiment with the fourth embodiment is configured so that the blade angle β of the center shroud line Lb makes a greater change than those of the blade angles β of the entrance-side shroud line La and the exit-side shroud line Lc, and the blade angle θ on the inlet side of the shroud line L2 and the blade angle θ on the inlet side of the hub line H2 have an angular difference of around 12°. Here, FIG. 17 is a graph showing changes in flow velocity on the pressure surfaces and suction surfaces on the shroud side of the conventional turbine blades and the turbine blades according to the first embodiment. FIG. 18 is a graph showing changes in pressure on the pressure surfaces and suction surfaces on the shroud side of the conventional turbine blades and the turbine blades according to the first embodiment.

The vertical axis of FIG. 17 indicates the flow velocity of the working fluid. The horizontal axis indicates the distance from the inlet to the outlet of the flow channel of the working fluid in a meridional cross section. Referring to FIG. 17, M1*a* is a graph of changes in flow velocity on the suction surfaces 101*b* on the shroud side of the turbine blades 101 of the conventional turbine rotor 100. M2*a* is a graph of changes in flow velocity on the suction surfaces 21*b* on the shroud side of the turbine blades 21 of the turbine rotor 6 which combines the first embodiment with the fourth embodiment. M3*a* is a graph of changes in flow velocity on the pressure surfaces 101*a* on the shroud side of the turbine blades 101 of the conventional turbine rotor 100. M4*a* is a graph of changes in flow velocity on the pressure surfaces 21*a* on the shroud side of the turbine blades 21 of the turbine rotor 6 which combines the first embodiment with the fourth embodiment.

Here, M3*a* and M4*a* show generally the same changes in flow velocity, whereas M1*a* and M2*a* show different changes in flow velocity. Specifically, it can be seen that M1*a* shows large changes in flow velocity in the midsection while the changes in flow velocity in the midsection of M2*a* are smaller than in M1*a*.

The vertical axis of FIG. 18 indicates the pressure of the working fluid. The horizontal axis indicates the distance from the inlet to the outlet of the flow channel R of the working fluid in a meridional cross section. Referring to FIG. 18, P1*a* is a graph of changes in pressure on the suction surfaces 101*b* on the shroud side of the turbine blades 101 of the conventional turbine rotor 100. P2*a* is a graph of changes in pressure on the suction surfaces 21*b* on the shroud side of the turbine blades 21 of the turbine rotor 6 which combines the first embodiment with the fourth embodiment. P3*a* is a graph of changes in pressure on the pressure surfaces 101*a* on the shroud side of the turbine blades 101 of the conventional turbine rotor 100. P4*a* is a graph of changes in pressure on the pressure surfaces 21*a* on the shroud side of the turbine blades 21 of the turbine rotor 6 which combines the first embodiment with the fourth embodiment.

Here, P3*a* and P4*a* show generally the same changes in pressure, whereas P1*a* and P2*a* show different changes in pressure. Specifically, P1*a* shows a drop in pressure in the midsection, while P2*a* shows higher pressures in the midsection as compared to P1*a*. It can thus be seen that a pressure difference between P4*a* and P2*a* is smaller than a pressure difference between P3*a* and P1*a*.

Figure 19:
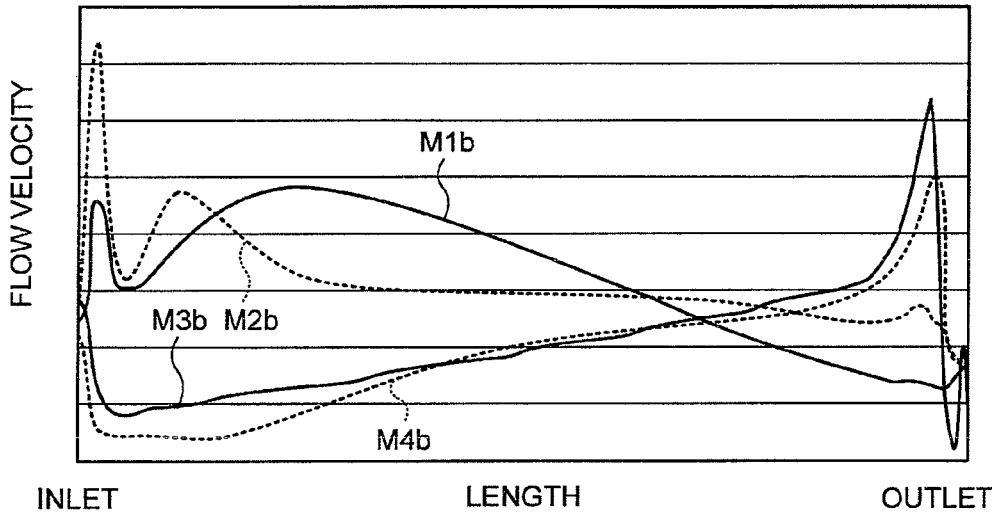
FIG. 19 is a graph showing changes in flow velocity on the pressure surfaces and suction surfaces on the shroud side of a conventional turbine blade and a turbine blade according to the second embodiment.
Figure 20:
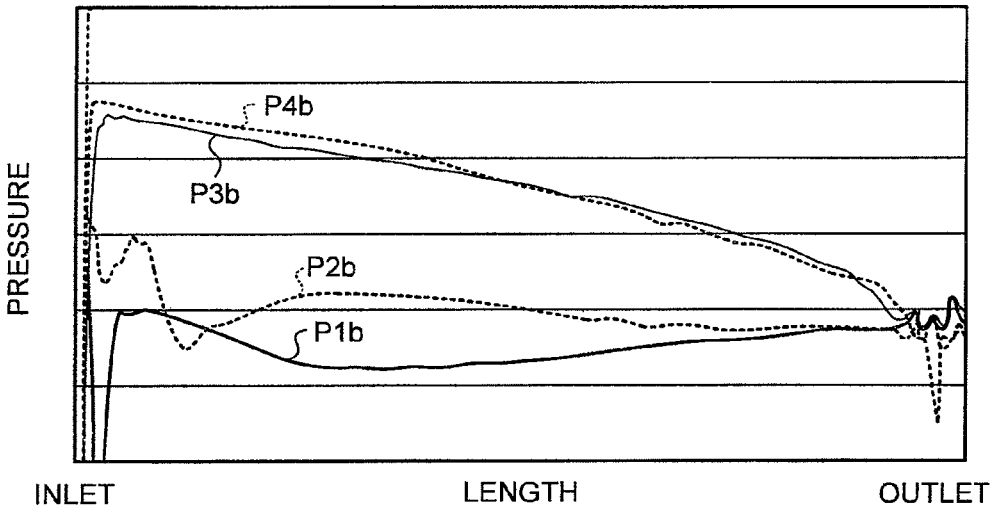
FIG. 20 is a graph showing changes in pressure on the pressure surfaces and suction surfaces on the shroud side of the conventional turbine blade and the turbine blade according to the second embodiment.

Next, the turbine rotor 30 which combines the second embodiment with the third and fourth embodiments is configured so that the blade angle β of the entrance-side shroud line La makes a greater change than those of the blade angles β of the center and exit-side shroud lines Lb and Lc. In a meridional cross section, the entrance-side shroud line La of the turbine blades is formed in an R shape, and the center and exit-side shroud lines Lb and Lc of the turbine blades are formed in an almost straight shape. Moreover, the blade angle θ on the inlet side of the shroud line L3 and the blade angle θ on the inlet side of the hub line H3 have an angular difference of around 20°. Here, FIG. 19 is a graph showing changes in flow velocity on the pressure surfaces and suction surfaces on the shroud side of the conventional turbine blades and the turbine blades according to the second embodiment. FIG. 20 is a graph showing changes in pressure on the pressure surfaces and suction surfaces on the shroud side of the conventional turbine blades and the turbine blades according to the second embodiment.

The vertical axis of FIG. 19 indicates the flow velocity of the working fluid. The horizontal axis indicates the distance from the inlet to the outlet of the flow channel R of the working fluid in a meridional cross section. Referring to FIG. 19, M1*b* is a graph of changes in flow velocity on the suction surfaces 101*b* on the shroud side of the turbine blades 101 of the conventional turbine rotor 100. M2*b* is a graph of changes in flow velocity on the suction surfaces 32*b* on the shroud side of the turbine blades 32 of the turbine rotor 30 which combines the second embodiment with the third and fourth embodiments. M3*b* is a graph of changes in flow velocity on the pressure surfaces 101*a* on the shroud side of the turbine blades 101 of the conventional turbine rotor 100. M4*b* is a graph of changes in flow velocity on the pressure surfaces 32*a* on the shroud side of the turbine blades 32 of the turbine rotor 30 which combines the second embodiment with the third and fourth embodiments.

Here, M3*b* and M4*b* show generally the same changes in flow velocity, whereas M1*b* and M2*b* show different changes in flow velocity. Specifically, it can be seen that M1*b* shows large changes in flow velocity in the midsection while the changes in flow velocity in the midsection of M2*b* are smaller than in M1*b*.

The vertical axis of FIG. 20 indicates the pressure of the working fluid. The horizontal axis indicates the distance from the inlet to the outlet of the flow channel R of the working fluid in a meridional cross section. Referring to FIG. 20, P1*b* is a graph of changes in pressure on the suction surfaces 101*b* on the shroud side of the turbine blades 101 of the conventional turbine rotor 100. P2*b* is a graph of changes in pressure on the suction surfaces 32*b* on the shroud side of the turbine blades 32 of the turbine rotor 30 which combines the second embodiment with the third and fourth embodiments. P3*b* is a graph of changes in pressure on the pressure surfaces 101*a* on the shroud side of the turbine blades 101 of the conventional turbine rotor 100. P4*b* is a graph of changes in pressure on the pressure surfaces 32*a* on the shroud side of the turbine blades 32 of the turbine rotor 30 which combines the second embodiment with the third and fourth embodiments.

Here, P3*b* and P4*b* show generally the same changes in pressure, whereas P1*b* and P2*b* show different changes in pressure. Specifically, P1*b* shows a drop in pressure in the midsection, while P2*b* shows higher pressures in the midsection as compared to P1*b*. It can thus be seen that a pressure difference between P4*b* and P2*b* is smaller than a pressure difference between P3*b* and P1*b*.

As can be seen from the foregoing, in the turbine rotor 6 which combines the first embodiment with the fourth embodiment, the working fluid flowing over the suction surfaces 21*b* on the shroud side of the turbine blades 21 makes smaller changes in flow velocity than that in the conventional one. This can make the pressure difference between P4*a* and P2*a* smaller than the pressure difference between P3*a* and P1*a*. Similarly, in the turbine rotor 30 which combines the second embodiment with the third and fourth embodiments, the working fluid flowing over the suction surfaces 32*b* on the shroud side of the turbine blades 32 makes smaller changes in flow velocity than that in the conventional one. This can make the pressure difference between P4*b* and P2*b* smaller than the pressure difference between P3*b* and P1*b*. As a result, it is possible to suppress an increase in the flow velocity of the working fluid on the suction surfaces 21*b* and 32*b* on the shroud side of the turbine blades 21 and 32. It is therefore possible to suppress a drop in pressure on the suction surfaces 21*b* and 32*b* on the shroud side, and suppress leakage of the working fluid through the clearance C between the turbine blades 21 or 32 and the shroud 24. It should be appreciated that, as described above, the first to fourth embodiments can be combined as appropriate to suitably suppress the leakage of the working fluid. While the first to fourth embodiments have dealt with the cases where the present invention is applied to a radial turbine, the present invention may be applied to a mixed flow turbine and an axial turbine.

INDUSTRIAL APPLICABILITY

As has been described above, the turbine rotor according to the present invention is useful for a turbine rotor that has a clearance formed between its turbine blades and shroud, and is particularly suited to suppressing leakage of the working fluid through the clearance for improved turbine efficiency.

REFERENCE SIGNS LIST

1 radial turbine
5 turbine casing
6 turbine rotor
11 outlet
13 inlet
20 hub
21 turbine blade
24 shroud
30 turbine rotor (second embodiment)
32 turbine blade (second embodiment)
34 inlet
35 outlet
50 turbine rotor (second embodiment)
51 turbine blade (second embodiment)
70 turbine rotor (third embodiment)
71 turbine blade (third embodiment)
75 inlet (third embodiment)
76 outlet (third embodiment)
100 turbine rotor (conventional art)
101 turbine blade (conventional art)
105 inlet (conventional art)
106 outlet (conventional art)
C clearance
L1 shroud line (conventional art)
L2 shroud line (first embodiment)
L3 shroud line (second embodiment)
H1 hub line (conventional art)
H2 hub line (first embodiment)
H3 hub line (second embodiment)
La entrance-side shroud line
Lb center shroud line
Lc exit-side shroud line
D1 turning position
D2 predetermined position
β blade angle
Δβ blade turning angle
θ blade angle
I1 inlet line (conventional art)
12 inlet line (the present invention)

The invention claimed is:

1. A turbine rotor of a turbine, a work fluid which flows into the turbine rotor in a radial direction through an inlet passing the turbine rotor and flowing out from an outlet, the turbine rotor comprising:

a hub that is rotatable about an axis of rotation; and a plurality of turbine blades that are arranged on a peripheral surface of the hub, and receive and direct the inflowing working fluid from the inlet toward the outlet, wherein the turbine blades each are connected to the hub at a bottom side, or hub side, and have a free end on a tip side, or shroud side, a line extending from the inlet to the outlet along a shroud-side edge of each turbine blade is a shroud line, and the shroud line includes;

a first shroud line that makes a small change from the inlet to a turning position toward the outlet in a blade angle with respect to the axis of rotation, a second shroud line that extends from the outlet side of the first shroud line and makes a greater change than that of the first shroud line from the turning position to a predetermined position, a third shroud line that extends from the outlet side of the second shroud line to the outlet and makes a smaller change than that of the second shroud line, the blade angle of the first shroud line decreases from the inlet to the turning position, a blade angle of the second shroud line increases from the turning position to the predetermined position, and a flow channel of the work fluid extending from the inlet to the outlet makes a turn in flowing direction from the radial direction to an axial direction via the turning position.

2. The turbine rotor according to claim 1, wherein an inlet line which is a line along an inlet-side edge of each of the turbine blades tilts in a direction of rotation with respect to the axis of rotation.

3. The turbine rotor according to claim 2, wherein the inlet line has a tilt angle of 10° to 25° with respect to the axis of rotation.

* * * * *